US006490732B1

(12) United States Patent
Spoke

(10) Patent No.: US 6,490,732 B1
(45) Date of Patent: Dec. 10, 2002

(54) SPREADER MEANS GARMENT

(76) Inventor: Conrad Spoke, 2002 E. River Rd. Apt. K-8, Tucson, AZ (US) 85718

( * ) Notice: Subject to any disclaimer, the term of this patent is extended or adjusted under 35 U.S.C. 154(b) by 43 days.

(21) Appl. No.: 09/899,666

(22) Filed: Jul. 5, 2001

(51) Int. Cl.[7] ..... A41D 5/00
(52) U.S. Cl. ..... 2/67; 2/406
(58) Field of Search ..... 2/67, 69, 400–408, 2/228, 227, 238

(56) References Cited

U.S. PATENT DOCUMENTS

| | | | | |
|---|---|---|---|---|
| 2,534,934 A | * | 12/1950 | Viniegra | 2/67 |
| 3,280,818 A | | 10/1966 | Pankey et al. | |
| 3,339,208 A | * | 9/1967 | Marbach | 2/400 |
| 3,774,241 A | * | 11/1973 | Zerkle | 2/228 |
| 4,394,781 A | | 7/1983 | Axmann | |
| 5,347,657 A | * | 9/1994 | Unsell | 2/67 |
| 5,396,662 A | | 3/1995 | Leonard et al. | |
| 5,467,482 A | * | 11/1995 | Crawford, II | 2/67 |
| 5,832,535 A | * | 11/1998 | Davis | 2/1 |
| 6,067,663 A | * | 5/2000 | Fernandez | 2/406 |

OTHER PUBLICATIONS

"A" shows the original bikini design of Reard as modeled in 1946.

"B" is a Life magazine article of May 16, 1949 which describes Charles L. Langs' invention and marketing of Poses.

"C" shows two swimsuits featured in the May 1995 issue of Vogue. Although the pubic panel components of these swimsuits bear a superficial resemblance to the present invention, their diamond shapes are not supported by internal stiff components. All four points of the diamond panels are held in tension by torso encircling components.

"D" shows a stiff, planar, fig–leaf leaf style of pubic covering as described in the Application.

"E" clearly demonstrates the classic triangulation geometry of bikini structure in a contemporary design, as published in *The Bikini Book* (copyright 1996, Reed International Books Limited).

* cited by examiner

*Primary Examiner*—Gloria M. Hale

(57) ABSTRACT

A bikini-style swimsuit having a diamond-shaped cloth pubic panel 10, and a spreader 22 which communicates with restraining pockets 20. The spreader extends the left and right extremities of the panel 10, tensing the cloth in the horizontal axis. A waistband 12 and a crotch panel 16 of typical bikini construction tense panel 10 in opposing directions in the vertical axis. An unexpected synergy of forces compels the entire periphery of the diamond-shaped panel 10 to be pulled into contact with the body of the wearer in an attractive and modest fashion.

2 Claims, 5 Drawing Sheets

SPREADER MEANS GARMENT

FEDERALLY SPONSORED RESEARCH

Not applicable.

SEQUENCE LISTING OR PROGRAM

Not applicable.

BACKGROUND—FIELD OF INVENTION

This invention relates to clothing for the human body, and relates more narrowly to bikini-style swimwear.

BACKGROUND—DESCRIPTION OF PRIOR ART

Since the introduction of the modern bikini swimsuit in 1946, designers have wrestled with the problem of securing small pieces of fabric to critical areas of the female body in a socially acceptable fashion. The original designs of Jacques Heim (which he called the "atome") and Reard (the "bikini") were considered by many to be too promiscuous for public beaches. In America, Vogue magazine did not deem the bikini acceptable until the mid-1960's. However, public standards have evolved, bringing smaller and lighter bikinis under the rubric of "decent".

Today, Heim and Reard's efforts seem quite conservative and perfectly functional. Their choice of essentially triangular shapes of cloth for covering three areas of the body—breasts, buttocks, and vulva—was practical and efficient. Regardless of the size or proportion of a triangular panel, it is being pulled taut at each corner. When each corner of each panel is joined to another either directly or via a ribbon of fabric, a taut and stable geometry results. For both the top and bottom halves of a Heim/Reard bikini there is a band of tensed materials encircling the torso of the wearer transversely. This stability is critical to the wearer's sense of security and modesty.

An automatic consequence of this geometry is that the vectors of tension which support a triangular panel inevitably radiate from points within the area of the triangle. (This is true of all three types of panels: breast-, buttocks-, and pubic-covering.) Because of this, even very small triangular panels produce sensations of stability for both the wearer and observers. The aesthetic of stability arises directly from the geometry of stability. This perfect union of form and function has never been successfully challenged in the realm of mass-marketed, publicly worn bikinis.

Many designers have attempted to create bikini panels which are supported on or attached to the body in atypical ways. U.S. Pat. No. 5,347,657 to Unsell (1994) discloses a bikini bottom section devoid of supporting strings or ribbons. The rear panel is supported by a hip-grasping arc of plastic, and the front panel is affixed by an adhesive strip. The absence of any visible means of support is an interesting novelty, but the means is highly impractical. Although the front panel is modest enough when first stuck on, its pressure sensitive adhesive strip tends to fail when submerged in water or when subject to moderate sweating. This is highly undesirable on a warm beach.

U.S. Pat. No. 5,467,482 to Crawford (1995) does not purport to be a bathing suit, but its support method deserves mention. This tanning brief is basically a pubic-covering panel suspended on a wire frame. A linear extension of the frame arcs upwards into the buttocks cleavage of the wearer. It is held in place by spring tension. Although this is a clever deviation from the bikini's connected-triangle geometry, it is not nearly stable enough to stay put while swimming.

In 1949 the unpatented Poses was introduced by Langs (Life magazine, May 16, 1949). It was little more than a pair of cloth cones affixed to the breasts with annular strips of adhesive. This strapless arrangement was a bold departure from the popular halter top, but it was suitable for static sunbathing and little else. Both because of its inherent insecurity and resemblance to a burlesque costume, it failed to find a market.

Burlesque and exotic dancing costuming discloses a relevant area of prior art which I will refer to as the "fig leaf" method. A fig leaf is a stiff planar element which covers the pubic area. Various stiffening materials include cardboard, wood lathes, wires, and plastics. Once covered with cloth or decorated with any number of light materials, the fig leaf is suspended from a very thin waist band. The lower edge may or may not be restrained. The horizontal extensions of a fig leaf have no visible means of support, giving an enticing and erotic appeal to both garment and wearer. These extensions, however, do not conform to the body of the wearer, making for a deliberately immodest garment. This is appropriate only to limited entertainment venues.

Another departure from the classic triangulation method of bikini construction is the shoulder-support approach. In a shoulder-support bikini there is no waistband transverse to the torso. Instead, pubic and buttocks panels have extensions which aim steeply upwards. These may spiral around or crisscross the torso in any number of ways, but support for pubic and buttocks panels ultimately comes from the shoulders of the wearer. Consequently, when the wearer bends her torso, panels may immodestly lift away from the body. This is remedied via additional connections between panel extensions and/or cords elsewhere on the torso. This complexity yields a garment which is typically clumsy and uncomfoatable. Also, such a garment often produces an unwanted array of tan lines.

When the current market for bikini swimwear is examined, many disadvantages are apparent:

(a) The Heim/Reard triangulation method of construction has become redundant. Its very efficiency has led to its ubiquity. Although there have been countless variations in materials, colors, proportions, and extraneous decorations, the architecture itself is stagnant.

(b) Deviations from the triangulation geometry have only been accomplished through the use of clumsy methodologies, such as adhesives, springs, and inelegant excesses of cords or fabrics.

(c) Bikinis deviating from the triangulation geometry do not affix securely to the wearer. They often require the constant attention of the wearer to keep their panels in place. Unusual geometries are often uncomfortable to the wearer, riding up and binding unexpectedly.

(d) Various alternate geometries involving adhesives or spring tension do not hold up to immersion in water. They are unsuitable as bathing wear.

(e) Novel bikini geometries have tended to be too revealing and immodest. These deviations are generally unsuitable for public beaches, swimming pools, and water parks.

OBJECTS AND ADVANTAGES

In relation to the last fifty-five years of bikini design, the present invention presents several objects and advantages:

(a) to provide a method of bikini construction which is novel in its underlying mechanics of structure.

(b) to provide a bikini with an outward appearance which differs markedly from the usual triangular outline without employing adhesives, springs, or ungainly and excessive restraint cords.

(c) to provide a novel bikini which is just as secure and stable as the classic triangulated architecture.

(d) to provide a novel bikini which reliably stays in place while swimming.

(e) to provide a novel bikini which is modest and suitable for all public swimming and sunbathing venues.

SUMMARY

In accordance with the present invention a garment comprises a diamond-shaped area of cloth held in tension at two opposing points by a waistband and a crotch panel, and simultaneously at the two remaining points by a spreader.

DRAWINGS

Drawing Figures

Figure 3:
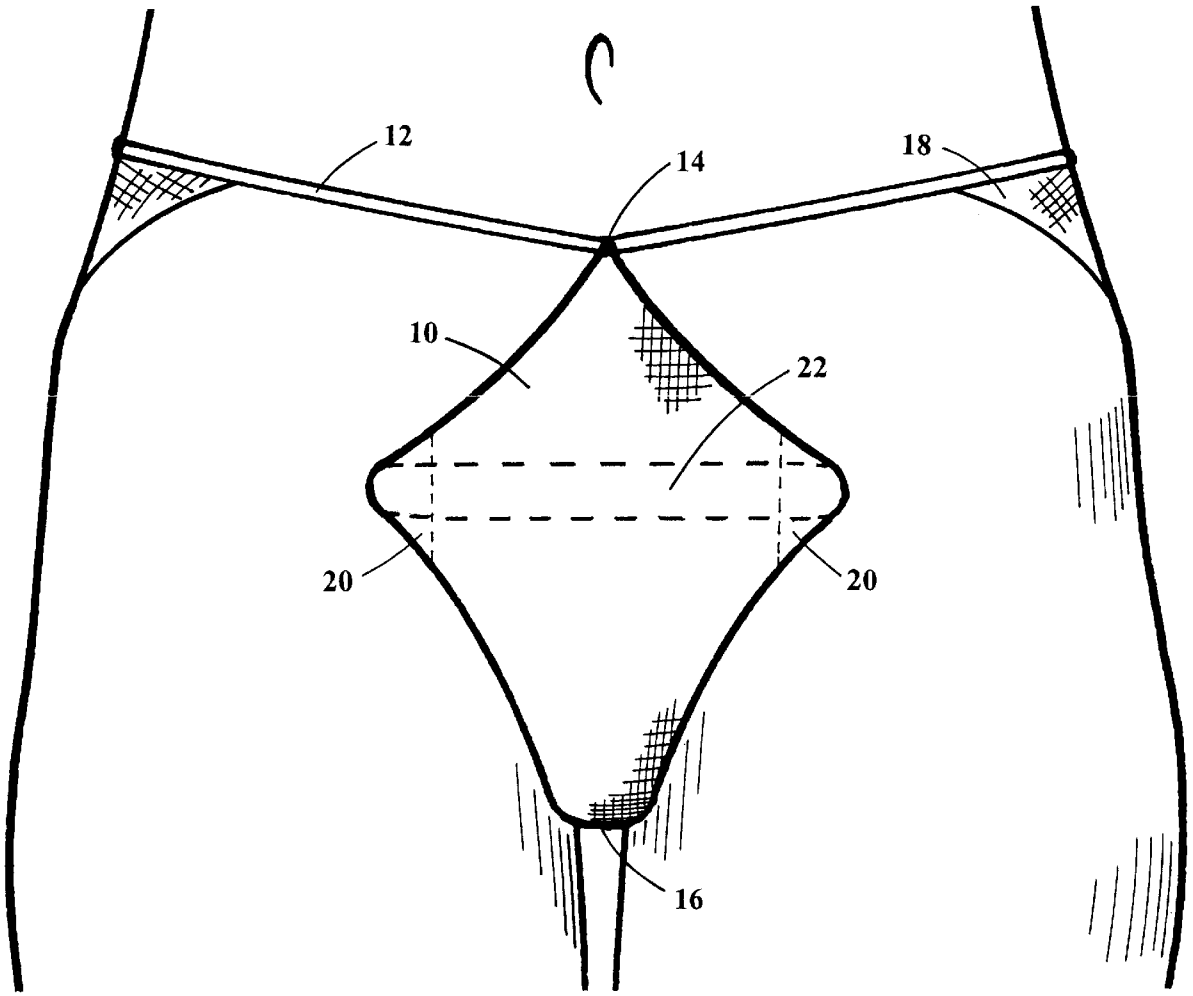

FIG. 3 references all parts comprising the preferred embodiment.

Figure 4:
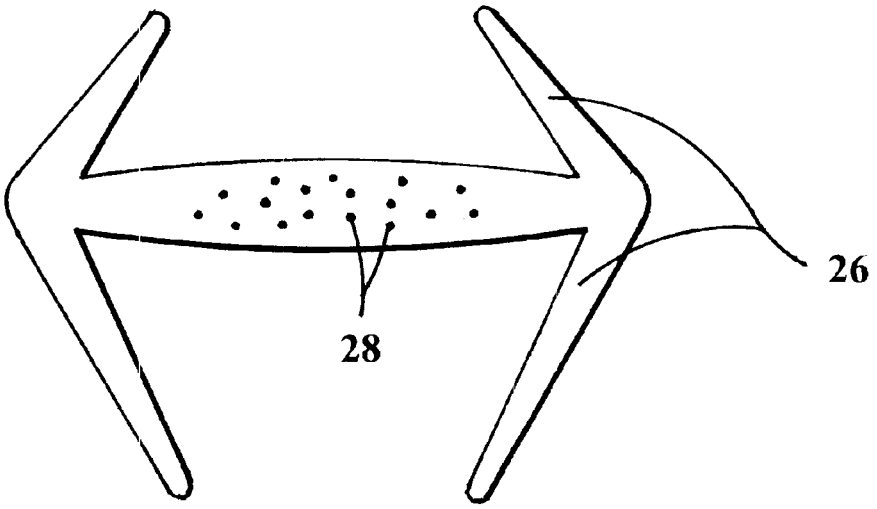
Figure 5:
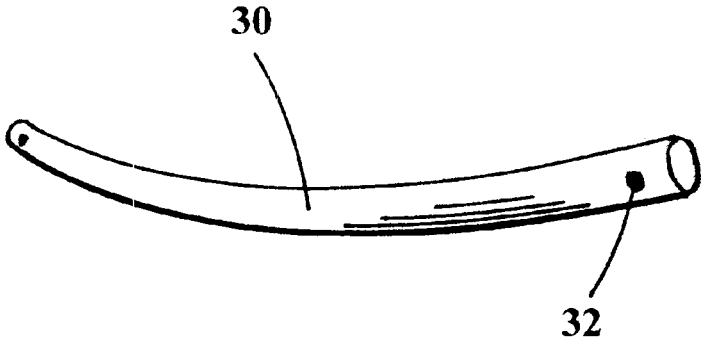

FIGS. 4 and 5 show variations of spreader design.

Figure 6:
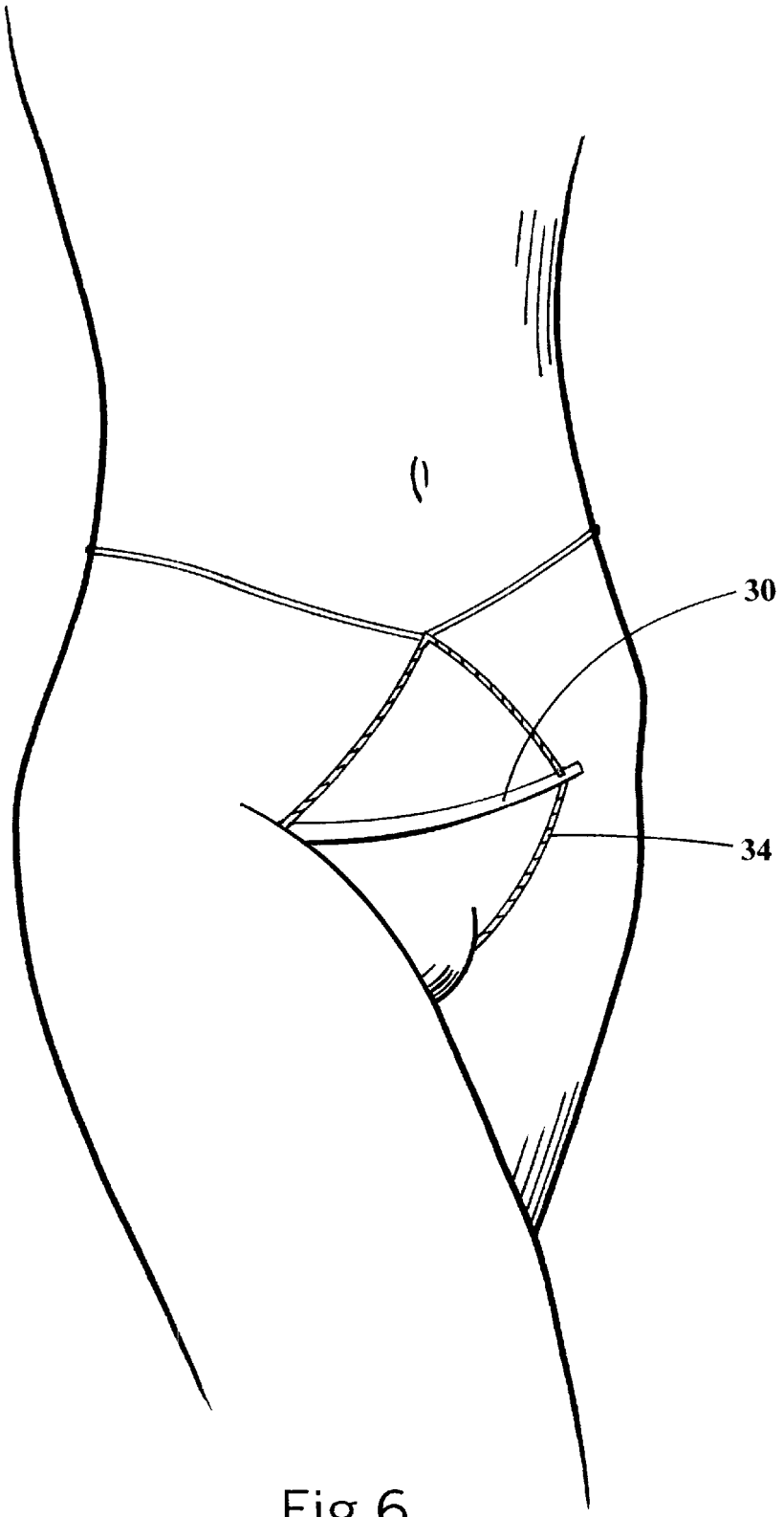

FIG. 6 shows the rigid spreader/elastic string embodiment.

REFERENCE NUMERALS IN DRAWINGS

| | |
|---|---|
| 10 | public panel |
| 12 | waist band |
| 14 | public panel/waistband junction |
| 16 | crotch panel |
| 18 | buttocks panel |
| 20 | restraining pockets |
| 22 | spreader |
| 24 | concave surface |
| 26 | spreader extensions |
| 28 | evaporation holes |
| 30 | rigid spreader |
| 32 | cord holes |
| 34 | peripheral cord |

DETAILED DESCRIPTION

Figure 1:
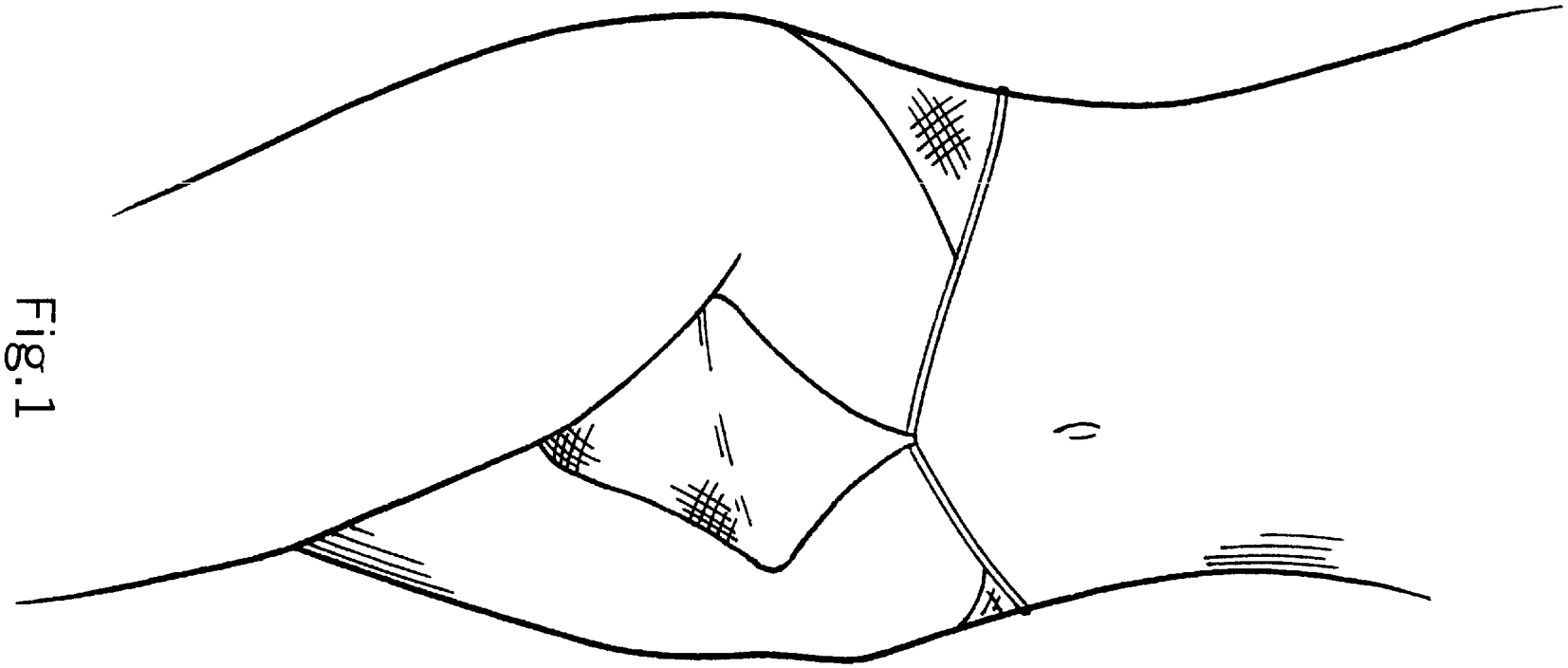
FIG. 1 shows a preferred embodiment, a female's pubic area-covering bikini panel.
Figure 2:
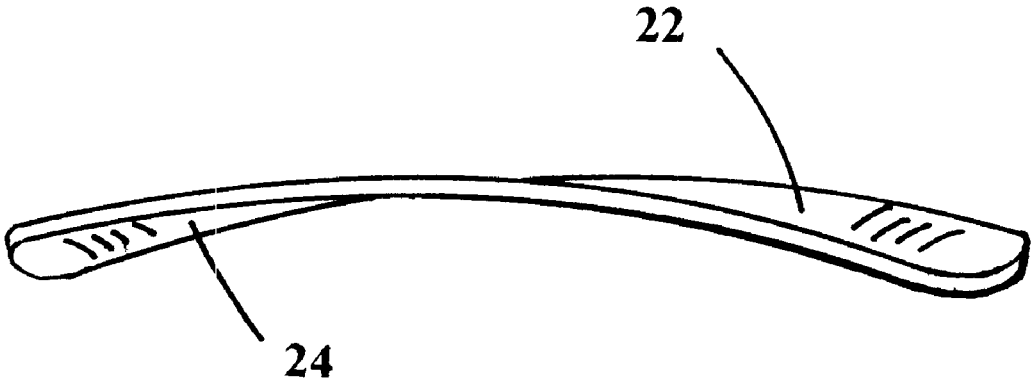
FIG. 2 shows the spreader for the preferred embodiment.

FIGS. 1, 2, and 3—Preferred Embodiment

A preferred embodiment of the garment of the present invention is illustrated in FIG. 1, which shows its natural appearance on a woman's body. FIG. 2 shows a spreader means in its simplest form. FIG. 3 reveals all referenced parts. A pubic panel 10 is a diamond-shaped area of cloth, and constitutes the front half of a woman's bikini swimsuit bottom. It is about 200 mm in height and 170 mm in width, but as with standard bikini pubic panels dimensions may vary considerably to suit the body size and personal preference of the wearer. Panel 10 may be comprised of any elastic cloth, including nylon/lycra and cotton/lycra. The fabric of pubic panel 10 should have an elasticity of at least 25% in both axes. Panel 10 may be comprised of a double layer of cloth, following the usual practice of combining an attractive outer layer with an inner liner layer. The lower point of the diamond is slightly truncated, being either seamed to or continuous with a crotch panel 16.

A preferred embodiment of spreader 22 is made of a polypropylene or polyethylene plastic which can be repeatedly bent to a tighter curvature without fatiguing. It is an arcuate shape whose dimensions are approximately 1×30×190 mm, though these may vary considerably to accommodate different garment sizes and elasticity characteristics of pubic panel 10. Its spherically concave surface 24 has a radius of about 150 mm.

Waistband 12, crotch panel 16, buttocks panel 18, and restraining pockets 20, may be composed of any materials found in their respective parts in typical bikinis. In this preferred embodiment waistband 12 is an elasticized fabric band or tubular elastic cloth. Crotch panel 16 has a width of about 70 mm, and may be continuous with either pubic panel 10 or buttocks panel 18, or may be comprised of extensions of both panels. Buttocks panel 18 may be an area of fabric sized to cover the entire buttocks of the wearer, or it may be a linear thong component, or it may be of an intermediate size.

Restraining pockets 20 are sewn on their outer edges to the outer edge of pubic panel 10. Their inward edges, represented by the vertical dashed lines, are not sewn down, resulting in two pockets hidden behind the left and right extremities of pubic panel 10. These pockets touch the body of the wearer.

The top point of the diamond of pubic panel 10 is affixed to waistband 12. The truncated bottom point of pubic panel 10 is affixed to, or continuous with, crotch panel 16. Crotch panel 16 continues rearward and affixes to, or is continuous with, buttocks panel 18. Buttocks panel 18 continues upward to affix to waistband 12 in a typical fashion.

When the garment is worn, pubic panel 10 is stretched taut at all points on its surface. Pubic panel 10 lies against and conforms to the contours of an area of the torso of the wearer. The horizontal thrust of spreader 22 reacts synergistically with the tensile forces of all other elastic components to produce this result. Contrary to what might be expected, the elastic recoil of panel 10 does not cause flexible spreader 22 to buckle outward and away from the torso of the wearer. The fabric of pubic panel 10 is put into a state of tension on its horizontal axis by spreader 22, and said panel is placed in tension in a vertical axis by the elastic forces of waistband 12 and crotch panel 16. As a result, the central area of pubic panel 10 imposes a pressure perpendicularly towards the torso of the wearer. This body-hugging pressure keeps spreader 22 from buckling upwards.

Variations in the construction of restraining pockets 20 are possible without in any way altering the spreader means method disclosed here. The preferred embodiment is illustrated with minimal pockets for the sake of clarity. The pockets may be larger, and may even have their free edges meet at the vertical center line of the inner face of the garment, thus forming a liner layer. Alternately, a conventional liner layer may feature a buttonhole opening. In such a variant the spreader may either remain between the two panel layers after being disengaged from the left and right pockets formed by the two panels, or it may be removed completely. A spreader may also be sewn in place between two panel layers, neither of which feature an aperature. In this variant even though the spreader is not directly touched, it is easily manipulated and engaged into the restraining pocket corners by handling it within the two layers of fabric.

FIG. 4—Alternative Spreader Embodiments

FIG. 4 shows spreader extensions 26 which are in the same plane as, and spherically curved to the same radius as, the main body of the spreader 22. These extensions are molded together with, and comprised of the same material as spreader 22. Although they are not necessary to the novel method of this invention, they may be added to provide additional support to the outer edges of a pubic panel in order to modify its periphery for aesthetic affect.

The proportions of the flexible spreader 22 may vary considerably. It may be wider or thicker at its center, then taper to a narrower width or thickness towards the ends. These dimensions may be varied to accomodate various degrees of elasticity of pubic panel fabric, or to accomodate various degrees of tension produced by other components.

The preferred embodiment of this invention employs a flexible spreader which spontaneously conforms to the torso of the wearer due to the tensions which the spreader itself creates in the cloth panel. However, this spreader may be composed of any arcuate, rigid material with a curvature which approximates the curvature of the relevant area of the wearer's torso. When a rigid spreader is applied to this garment, panel 10 is tensed on two axes, just as in the preferred embodiment, yielding an entire surface of tensed fabric. Similarly, the panel imposes a pressure on the spreader perpendiculary towards the torso. The rigid arcuate spreader is brought into contact with the body. The outward appearance of a garment employing a rigid spreader is virtually identical to the preferred embodiment.

Spreader 22 may be perforated with transverse evaporation holes 28 to speed the evaporation of trapped water or sweat.

FIGS. 5 and 6—Alternative Spreader and Pubic Panel Embodiment

Instead of being in a state of tension, the fabric of the pubic panel may be draped. FIG. 5 shows a stiff, rigid, arcuate spreader 30 with parallel cord holes 32 traversing the spreader near either end. Rigid spreader 30 may be composed of any relatively inflexible material. Its radius of curvature may vary so as to follow the curvature of the corresponding area of the wearer's torso.

FIG. 6 shows the support structure of the draped panel embodiment, with the draped pubic panel removed for clarity. An elastic peripheral cord 34 passes through both of the spreader's cord holes 32. Cord 34 is attached at its midpoint to waistband 12. The two ends of the peripheral cord 34 affix to the left and right edges of pubic panel 10.

Rigid spreader 30 creates a synergistic system with elastic cord 34. Elastic cord 34 is pulled tense into the shape of a diamond. A non-elastic area of fabric may now be draped on any components of the resultant system.

Advantages

The above descriptions reveal a number of advantages of a bikini swimsuit employing my spreader means innovation:

(a) The introduction of a spreader to the usual elastic materials of bikini construction yields an entirely novel construction which is entirely different than a typical triangular panel with three points of tensile support.

(b) The spreader means produces a diamond-shaped front panel which surprisingly appears to be unsupported at the left and right corners, a result which is delightful to the eye.

(c) This garment stays reliably in place, and does not require constant attention and adjustments by the wearer.

(d) A spreader means garment is suitable for swimming, as well as walking and running.

(e) This bikini conforms to standards of modesty recognized at public beaches, swimming pools, and water parks.

Operation

The bikini swimsuit bottom of the preferred embodiment is stored with the spreader 22 removed from the pockets. The garment is put on in the normal fashion. There is now a vertical, linear area of tension between pubic panel/waistband junction 14 and crotch panel 16. All areas of fabric of pubic panel 10 to the left and right of this narrow vertical area fall limp.

Spreader 22 is then aligned behind panel 10 in a horizontal orientation, with its concave surface 24 facing the wearer. One end of spreader 22 is fit into a restraining pocket 20. The remaining limp corner of panel 10 is stretched horizontally such that the free end of spreader 22 can be slipped into the remaining restraining pocket 20.

When released, the entire area of the panel recoils against the lower abdomen of the wearer. The flexible spreader 22 conforms to the curvature of the torso of the wearer's body. The entire diamond-shaped area of fabric is now stretched taut. Nowhere does the panel sag or drape. The panel's entire periphery makes contact with the body, concealing this area of the body satisfactorily. The wearer may move their legs and body into any position without shifting, lifting, or in any way displacing the invention from the position shown in FIG. 1.

In the alternative embodiment of FIG. 6, rigid spreader 30 is part of the permanent construction of the garment. When the garment is not being worn the elastic peripheral cord 34 is in a relaxed state. The non-elastic area of fabric (not shown) which is affixed to peripheral cord 34 and crotch panel 16 is in a relaxed or bunched-up state. When this embodiment is worn, peripheral cord 34 is drawn into the tensed orientation shown. The resulting diamond shape of elastic cord is automatically pulled into contact with the body of the wearer all along its length, except for the short distance where it passes through and is lifted by a cord hole 32. Rigid spreader 30 is also drawn inward against the wearer's body. The area of fabric affixed to peripheral cord 34 and crotch panel 16 is consequently pulled toward the wearer, such that it covers an area of the body defined by the limits of peripheral cord 34.

The synergistic interaction of a flexible spreader and an elastic panel as shown in this embodiment most completely demonstrates the originality and uniqueness of this invention. Both the flexible spreader and the cloth panel automatically conform to the generally spherical contour of this area of the wearer's body.

Observing this synergy step by step, first note that the waistband keeps the upper extremity of the panel in contact with the body. Next, the crotch panel pulls in opposition to the waistband, drawing the garment in the vertical axis, longitudinally, around the lower torso. When the spreader is installed, the left and right extremities of the panel are extended on a horizontal axis, equatorially, around the torso. Vertical tensions have now been displaced and distributed across all points on the fabric panel, all the way to and including the four edges of the resultant quadrilateral. The fabric which is in contact with a given end of the spreader is now being acted on by two vectors of force which intersect at an approximately 90 degree angle at the extremity, one vector leading to the waistband attachment point, the other to the crotch panel. These two lines of force reach around the global contour of the body, and act to draw the panel extremity into the surface of the torso with considerable force. Simultaneously, the fabric of the central portion of the panel is being tensed by forces pulling out in all directions of its plane. This fabric is pulled towards the body by the body-ward forces acting on the two panel extremities. This central panel tension in turn keeps the flexible spreader from buckling outwards.

This invention has been actually reduced to practice with many variations of size and proportion by its inventor. It has been demonstrated repeatedly that the unique dynamics of the system reliably results in the quadrilateral area of cloth panel being pulled firmly against the body of its wearer.

Conclusions, Ramifications, and Scope

It has now been shown that the present invention reveals both an entirely new methodology of construction and a brand new style of bikini for women. Both method and style are achieved simultaneously, through the use of a simple spreader element, in a way which has never been disclosed either for clothing in general or for a bikini bottom in particular. The action of the spreader creates a synergistic array of forces in the materials such that the diamond-shaped front panel is pulled neatly and attractively against the body. This invention is a significant developement in the evolution of bikini-style swimwear in that

- it operates via a simple but fascinating machine which differs utterly from classic Heim/Reard bikini structure;
- it has a surprising and delightful diamond shape, unsupported at the corners by adhesives or extra strings;
- it rests against the body lightly and comfortably, but its orientation is reliably fixed;
- it will stay in place as the wearer swims, walks, or moves their body into any position;
- it covers the pubic area of the body in a socially acceptable fashion.

I claim:

1. A garment to cover a convex area of a person, comprising:

(a) a generally quadrilateral area of elastic fabric;

(b) attachment means to fixedly engage opposing corners of said quadrilateral area of said elastic fabric, said attachment means subsequently fixedly engaging other garment elements, said garment elements being arrayed so as to impose forces of tension in opposition, whereby a narrow area of said quadrilateral area of elastic fabric is placed in a state of tension;

(c) a spreader means to fixedly engages two remaining unattached corners of said quadrilateral area of said elastic fabric, said spreader being long enough to place said fabric in a state of tension on an axis congruent with the orientation of said spreader, whereby said quadrilateral area of fabric is stretched tautly at all points, and is held firmly against said convex area of said person.

2. A garment for covering a convex area of a person, comprising:

(a) a generally quadrilateral area of fabric having perimeter edges;

(b) a length of elastic cord somewhat shorter than a sum of the cumulative perimeter edges of said area of said fabric;

(c) attachment means to fixedly engage both ends of said cord to a first garment element;

(d) means to fixedly engage an approximate midpoint of said cord to a second garment element, thereby yielding two approximately equal segments of said cord;

(e) a spreader means which fixedly engage the approximate midpoints of said two segments of said elastic cord, said spreader being long enough to place both of said two segments of said cord in a state of tension, yielding a quadrilateral array of tensed elastic cord;

(f) attachment means to fixedly engage numerous points on the perimeter edges of said quadrilateral area of fabric to numerous points on said quadrilateral array of said elastic cord, whereby circumference of said quadrilateral area of fabric is held in contact with said convex area of said person.

* * * * *